US007896928B2

(12) United States Patent
Short et al.

(10) Patent No.: US 7,896,928 B2
(45) Date of Patent: Mar. 1, 2011

(54) IONIZED PERFORMANCE FABRIC COMPOSITION

(75) Inventors: Dan C. Short, Paris, KY (US); Woflgang A. Strahl, Wilmington, NC (US); Ellis Davis, Jr., Easley, SC (US); John D. Tumer, Inman, SC (US)

(73) Assignee: STRA, LLC, Easley, SC (US)

( * ) Notice: Subject to any disclaimer, the term of this patent is extended or adjusted under 35 U.S.C. 154(b) by 142 days.

(21) Appl. No.: 12/182,275

(22) Filed: Jul. 30, 2008

(65) Prior Publication Data

US 2009/0029614 A1 Jan. 29, 2009

Related U.S. Application Data

(63) Continuation of application No. 11/246,536, filed on Oct. 7, 2005.

(60) Provisional application No. 60/616,999, filed on Oct. 8, 2004.

(51) Int. Cl.
*D06M 13/10* (2006.01)
*D06M 13/184* (2006.01)

(52) U.S. Cl. ..... 8/115.6; 8/115.51; 8/115.7; 8/116.1; 8/120; 8/112; 252/8.61

(58) Field of Classification Search ..... 8/115.51, 8/115.6, 115.7, 116.1, 112, 120; 252/8.61–8.82
See application file for complete search history.

(56) References Cited

U.S. PATENT DOCUMENTS

| | | | | |
|---|---|---|---|---|
| 2,681,846 | A | | 6/1954 | Guthrie et al. |
| 2,726,133 | A | | 12/1955 | Helfenberger et al. |
| 3,783,085 | A | | 1/1974 | Person et al. |
| 4,181,498 | A | | 1/1980 | Koltai et al. |
| 4,244,059 | A | | 1/1981 | Pflaumer |
| 4,455,187 | A | | 6/1984 | von Blucher et al. |
| 4,510,193 | A | | 4/1985 | Blucher et al. |
| 4,702,857 | A | * | 10/1987 | Gosselink ..... 510/299 |
| 4,975,317 | A | | 12/1990 | Kuhn et al. |
| 5,057,710 | A | | 10/1991 | Nishiura et al. |
| 5,478,489 | A | | 12/1995 | Fredj et al. |
| 5,490,865 | A | | 2/1996 | Scheiwiller |
| 5,539,930 | A | | 7/1996 | Sesselmann |

(Continued)

FOREIGN PATENT DOCUMENTS

| | | |
|---|---|---|
| JP | 49033718 | 9/1974 |

OTHER PUBLICATIONS

Lewis, D.M. et al., Improved Cellulous Dyeability by Chemical Modificationof the Fiber, Textile Chemist and Colorist, Oct. 1989, p. 23.

(Continued)

*Primary Examiner*—Lorna M Douyon
*Assistant Examiner*—Tri V Nguyen
(74) *Attorney, Agent, or Firm*—MacCord Mason PLLC

(57) ABSTRACT

A composition for treating fabric includes about 0.1 to about 10.0% cross linking agent, about 0.1 to about 5.0% polyolefin, about 0.1 to about 0.5% wetting agent, about 0.0 to about 8.0% aminofunctional silicone, about 0.0 to about 6.0% ionizing agent, about 0.0 to about 2.0% catalyst and any remainder as a carrier. The composition has a pH of between about 2.0 to about 4.0 and at least some aminofunctional silicone and/or ionizing agent is provided.

13 Claims, 2 Drawing Sheets

U.S. PATENT DOCUMENTS

| | | | | |
|---|---|---|---|---|
| 5,578,249 | A | 11/1996 | Ohtani et al. | |
| 5,645,627 | A | 7/1997 | Lifshutz et al. | |
| 5,726,107 | A | 3/1998 | Dahringer et al. | |
| 5,871,845 | A | 2/1999 | Dahringer et al. | |
| 5,910,622 | A | 6/1999 | Brodmann | |
| 6,134,718 | A | 10/2000 | Sesselmann | |
| 6,149,549 | A | 11/2000 | Login et al. | |
| 6,336,943 | B1 | 1/2002 | Login et al. | |
| 6,468,320 | B1 | 10/2002 | Sumitani et al. | |
| 6,550,639 | B2 | 4/2003 | Brown et al. | |
| 6,699,828 | B1 * | 3/2004 | de Buzzaccarini et al. | 510/372 |
| 6,884,767 | B1 | 4/2005 | Frankenbch et al. | |
| 7,041,630 | B1 | 5/2006 | Frinh et al. | |
| 2004/0010858 | A1 * | 1/2004 | Detering et al. | 8/115.51 |
| 2004/0147423 | A1 * | 7/2004 | Scialla et al. | 510/372 |
| 2006/0021150 | A1 * | 2/2006 | Hu et al. | 8/115.51 |

OTHER PUBLICATIONS

Harper, Robert J., Cationic Polyacrylates for Garment Dyeing, J. or Coated Fabarics; Apr. 1989, vol. 18, pp. 234-245.
Harper, Robert J., Crosslinked Cationic Cotton via Ethoxylated Quaternaries, J. of Coated Fabrics; Jan. 1988; vol. 17, pp. 197-211.
Technical Textiles LLC brochure (2pp) date unknown.
www.farabloc.com website: Farabloc paiin management clothing and products information; 10 pgs.
www.fitandfiddle.com website: Q-Ray Ionized Bracelet, 4 pgs.
Saratoga Pubications Limited re: chemical protective clothing; 4 pgs.
Clement, D.B. et al., Alleviation of pain with the use of Barabloc, an electromagnetic shield: A review; BC Medical J., Dec. 2002, pp. 573-577, vol. 43, No. 10.

* cited by examiner

IONIZED PERFORMANCE FABRIC COMPOSITION

The present invention is a continuation application of U.S. application Ser. No. 11/246,536, filed on Oct. 7, 2005, which claims the benefit of U.S. Provisional Patent Application Ser. No. 60/616,999 filed on 8 Oct. 2004.

TECHNICAL FIELD

The present invention relates generally to the clothing field and, more particularly, to specialty garments, fabrics for specialty garments, surgical masks, bandages and tapes and compositions for treating those fabrics and products. The compositions are also useful in treating medical wraps and domestic fabrics such as sheeting, pillowcases, bed coverings, and throws.

BACKGROUND OF THE INVENTION

The present invention relates to specialty fabrics and clothes such as shirts, pants, socks, underwear and undergarments, sweaters, coats, gloves, mittens, shoes, hats and other head wear. The invention also relates to surgical masks, bandages and tapes as used in the medical field. Individuals wearing clothing, bandages, wraps and/or tapes constructed from the specialty fabric of the present invention against their skin have observed substantial increases in oxygen levels in the bloodstream, circulation and muscle recovery, static and dynamic endurance, performance, speed, quickness and reaction time. Further, wearers of the specialty fabric have also experienced energized endorphins, increases in immunologic A, an important immune factor, and enhanced anti-inflammatory effectiveness. Wearing the clothing, bandages, wraps and/or tapes of the present invention enables an athlete to perform better, perform longer and have greater muscle elasticity, less warm up time and faster recovery. A person sleeping on mattress covers, sheets and pillowcases containing this treatment will enjoy a deeper, more relaxing sleep and awake feeling more rested.

SUMMARY OF THE INVENTION

In accordance with the purposes of the present invention as described herein, a composition is provided for treating fabric. The composition comprises in weight percent about 0.1 to about 10.0% cross linking agent, about 0.1 to about 5.0% polyolefin, about 0.1 to about 0.5% wetting agent, about 0.0 to about 8.0% aminofunctional silicone, about 0.0 to about 6.0% ionizing agent, about 0.0 to about 2.0% catalyst and any remainder as a carrier. The composition has a pH of between about 2.0 to about 4.0 and at least some aminofunctional silicone and/or ionizing agent is provided in the composition. This is necessary in order to provide the desired ionization effect to the fabric.

More specifically describing the invention, the cross linking agent is selected from a group consisting of a polycarboxylic acid, a low molecular weight polymaleic acid, a copolymer of maleic acid and other monomers, citric acid, butanetetracarboxylic acid and mixtures thereof and the polyolefin is selected from a group consisting of polyethylene, polypropylene and mixtures thereof.

The aminofunctional silicone is ionizeable and is selected from a group consisting of silicone polymers containing amine groups and mixtures thereof. The catalyst is selected from a group consisting of sodium hypophosphite, sodium phosphate, sodium hydroxide, sodium carbonate and mixtures thereof. The ionizing agent is selected from a group consisting of choline chloride, other reactive quaternary compounds and mixtures thereof.

The wetting agent is selected from a group consisting of nonionic and anionic surfactants and mixtures thereof. The carrier is selected from a group consisting of water, air, alcohol, other water soluble compounds and mixtures thereof with or without water.

In accordance with an additional aspect of the present invention a composition for treating fabric comprises in weight percent about 1.0 to about 4.0% cross linking agent, about 0.2 to about 4.0% aminofunctional silicone, about 0 to about 3.0% polyolefin, about 0.1 to about 0.5% wetting agent, about 1.0 to about 6.0% ionizing agent, about 0.5 to about 2.0% catalyst and any remainder as a carrier. The composition has a pH of between about 2.6 to about 4.0.

In accordance with yet another aspect of the present invention a performance fabric is provided. The performance fabric comprises a fabric substrate treated with the above-described composition. That fabric substrate may be a noncellulosic synthetic material such as nylon, polyester, elastomers, acrylics, and any mixtures thereof, natural fibers materials such as cotton, kenaf, hemp, wool, silk, leather and any mixtures thereof or blends of natural fibers and noncellulosic synthetic materials.

Still further the invention includes a method of preparing a performance fabric. That method comprises treating a fabric substrate with the above-described composition.

In accordance with an additional aspect of the present invention, a composition for treating fabric comprises by weight percent about 0.1 to about 15.0% fixative, about 0.1 to about 10.0% acid or acid salt with ionization properties, about 0.1 to about 8.0% fixative catalyst, about 0.1 to about 8.0% polyolefin, about 0.1 to about 8.0% aminofunctional silicone, about 0.01 to about 4.0% wetting agent and any remainder as a carrier.

The fixative is selected from a group consisting of urea, dimethyloldihydroxyethyleneurea, dimethylureaglyoxal and mixtures thereof, the acid or acid salt with ionization properties is selected from a group consisting of sulfamic acid, sulfamic acid salt, ammonium sulfamate, sodium sulfamate, magnesium sulfamate, phosphoric acid, the sodium salt of phosphoric acid, polycarboxylic acid, citric acid, butanetetracarboxylic acid, polymers and copolymers containing maleic acid, acrylic acid and their sodium salts and mixtures thereof and the polyolefin is selected from a group consisting of polyethylene, polypropylene and mixtures thereof. The fixative catalyst is selected from a group consisting of magnesium salts, magnesium chloride, magnesium chloride activated with citric acid, salts of phosphoric acid and mixtures thereof.

The aminofunctional silicone is selected from a group consisting of various silicone polymers containing amine groups and mixtures thereof. The wetting agent is selected from a group of nonionic and anionic surfactants and mixtures thereof.

The composition may also include between about 0.1 to about 5.0% blocked copolymer of polyester/polyethylene glycol.

Still further describing the invention a composition for treating fabric comprises by weight percent about 2.0 to about 8.0% fixative, about 1.0 to about 5.0% acid or acid salt with ionization properties, about 1.0 to about 4.0% fixative catalyst, about 0.2 to about 4.0% polyolefin, about 0.2 to about 4.0% aminofunctional silicone, about 0.1 to about 2.0% wetting agent and any remainder as carrier. This composition may also include between about 0.1 to about 5.0% blocked copolymer of polyester/polyethylene glycol.

Still further, a performance fabric comprises a fabric substrate treated with a composition having by weight percent about 0.1 to about 15.0% fixative, about 0.1 to about 10.0% acid or acid salt with ionization properties selected from a group consisting sulfamic acid, sulfamic acid salt, ammonium sulfamate, sodium sulfamate, magnesium sulfamate, phosphoric acid, the sodium salt of phosphoric acid, polycarboxylic acid, citric acid, butanetetracarboxylic acid, polymers and copolymers containing maleic acid, acrylic acid and their sodium salts and mixtures thereof, about 0.1 to about 8.0% fixative catalyst, about 0.1 to about 8.0% polyolefin, about 0.1 to about 8.0% aminofunctional silicone, about 0.01 to about 4.0% wetting agent and any remainder as carrier. The fabric substrate may be a cellulosic material such as cotton, rayon, linen and other bast fibers and mixtures thereof. The fabric substrate may be a natural cellulosic fiber or a blend of cellulosic fibers and synthetic fibers. When synthetic fibers such as polyester fibers are present, the composition may also include between about 0.1 to about 5.0% blocked copolymer of polyester/polyethylene glycol.

Still further the invention includes a method of preparing a performance fabric comprising treating a fabric substrate with a composition having by weight percent about 0.1 to about 15.0% fixative, about 0.1 to about 10.0% acid or acid salt with ionization properties selected from a group consisting of sulfamic acid, sulfamic acid salt, ammonium sulfamate, sodium sulfamate, magnesium sulfamate, phosphoric acid, the sodium salt of phosphoric acid, polycarboxylic acid, citric acid, butanetetracarboxylic acid, polymers and copolymers containing maleic acid, acrylic acid and their sodium salts and mixtures thereof, about 0.1 to about 8.0% fixative catalyst, about 0.1 to about 8.0% polyolefin, about 0.1 to about 8.0% aminofunctional silicone, about 0.01 to about 4.0% wetting agent and any remainder as carrier.

In the following description there is shown and described several preferred embodiments of this invention, simply by way of illustration of some of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWING

The accompanying drawing incorporated in and forming a part of this specification, illustrates several aspects of the present invention and together with the description serves to explain certain principles of the invention. In the drawing.

Figure 1:
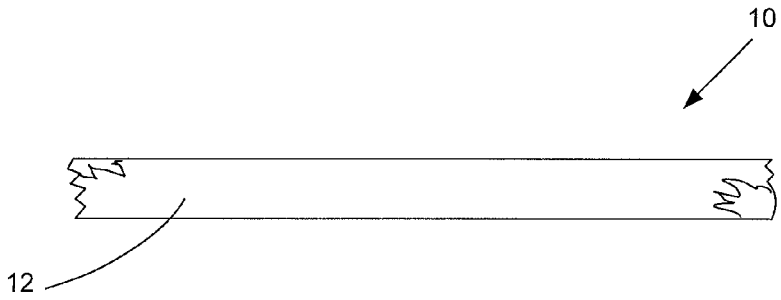
FIGS. 1-3 are cross-sectional views illustrating three possible embodiments of the specialty fabric of the present invention.

Reference will now be made in detail to the present preferred embodiments of the invention, examples of which are illustrated in the accompanying drawing.

DETAILED DESCRIPTION OF THE INVENTION

In accordance with the present invention an ionized finish is durably fixed to a textile fabric by treating the fabric in an appropriate composition. The particular chemistry utilized to impart ionized groups to the fabric depends upon the particular textile fiber and the balance of physical and chemical properties expected from the finished fabric. The goal is to provide an ionized finish that will function to enhance the physiologic and athletic performance of the wearer or to provide a more relaxing night's sleep.

One composition useful in the present invention comprises in weight percent about 0.1 to about 10.0% cross linking agent, about 0.1 to about 5.0% polyolefin, about 0.1 to about 0.5% wetting agent, about 0.0 to about 8.0% aminofunctional silicone, 0.0 to about 6.0% ionizing agent, 0.0 to about 2.0% catalyst and any remainder as a carrier wherein the composition has a pH of between about 2.0 to about 4.0.

More typically the composition includes about 1.0 to about 4.0% cross linking agent, about 0 to about 3.0% polyolefin, about 0.1 to about 0.5% wetting agent, about 1.0 to about 6.0% ionizing agent, about 0.5 to about 2.0% catalyst, about 0.2 to about 4.0% aminofunctional silicone and a carrier with the composition having a pH of between about 2.6 and about 4.0. The polyolefin is typically polyethylene and/or polypropylene. The aminofunctional silicone functions as a softener while also providing an ionization effect and is typically used in the composition when treating cotton and cotton blend fabrics. It does not have to be but could be included in the composition when treating synthetics.

The cross linking agent may be substantially any appropriate material useful for the intended purpose of binding the ionizing agent to the fabric being treated. Cross linking agents include but are not limited to polycarboxylic acid, low molecular weight polymaleic acid, a copolymer of maleic acid and other monomers, citric acid, butanetetracarboxylic acid and mixtures thereof. Other effective cross linking agents include polyfunctional blocked isocyanates and polyfunctional epoxides.

The aminofunctional silicones must be an ionizeable silicone and may, for example, be selected from a group consisting of various silicone polymers containing amine groups. The amine groups may be primary, secondary, tertiary, or quaternary and mixtures thereof. Catalysts appropriate for use in the composition of the present invention include sodium hypophosphite, sodium phosphate, sodium hydroxide, sodium carbonate and mixtures thereof. Ionizing or finishing agents appropriate for use in the composition include but are not limited to choline chloride or other reactive quaternary compounds (e.g. glycidyl-trimethylammonium chloride, chitosan (under slightly acid conditions) and those described in publications: *Textile Chemist and Colorist*, October 1989, p. 23 by David M. Lewis and Xiaoping Lei; *Journal of Coated Fabrics*, Vol. 18, April 1989, p. 234 by R. J. Harper, Jr.; *Journal of Coated Fabrics*, Vol. 17, January 1988, p. 197 by R. J. Harper, Jr. and A. H. Lambert) and mixtures thereof. Wetting agents useful in the present invention include but are not limited to nonionic and anionic surfactants and mixtures thereof. Usually the carrier is water. However, other carriers such as air, alcohols, and other water soluble compounds and mixtures thereof with or without water may be utilized.

This composition is particularly useful in treating wool, silk, regenerated cellulose and noncellulosic, synthetic fibers such as polyester, nylon, elastomerics, acrylics, and mixtures thereof whether blended with cellulosic fibers or not.

The composition is applied to the fabric by blotting, spraying, soaking, foaming or any other appropriate means. The composition is then dried and cured. The percent wet pickup may vary from 10 to 120 percent depending on the fabric and the level of treatment desired. After drying, the cure temperature will depend on the time permitted for curing. Conditions may vary from, for example, 10 seconds at 380° F. to 20 minutes at 280° F. It is the cross linking agent that is effective in fixing the cationic compound such as choline chloride to the fabric. This reaction in combination with oxidized polyolefins, such as polyethylene and polypropylene, and aminofunctional silicones have been effective in achieving desirable ionic properties on the wool or synthetic fibers.

A second compositional embodiment of the present invention generally comprises by weight about 0.1 to about 15.0% fixative, about 0.1 to about 10.0% acid or acid salt, about 0.1 to about 8.0% fixative catalyst, about 0.1 to about 8.0% polyolefin, about 0.1 to about 8.0% aminofunctional silicone, about 0.01 to about 4.0% wetting agent and the remainder as a carrier. More typically the second embodiment of the composition comprises about 2.0 to about 8.0% fixative, about 1.0 to about 5.0% acid or acid salt, about 1.0 to about 4.0% fixative catalyst, about 0.2 to about 4.0% polyolefin, about 0.2 to about 4.0% aminofunctional silicone, about 0.1 to about 2.0% wetting agent and any remainder as carrier.

In this second compositional embodiment the fixative aids in fixing the sulfamate salts that provide the ionization effect to the fabric being treated. This is particularly true when the fabric includes cellulosic fibers. Further, the fixative may also serve to provide an ionization effect. For example, a polymer containing maleic acid such as a copolymer of maleic acid and acrylic acid may fix itself on a cellulose or a synthetic fiber and have ionization properties. The fixative may be selected from a group consisting of urea, dimethyloldihydroxyethyleneurea, dimethylureaglyoxal and mixtures thereof. The acid or acid salt serves as an agent to provide ionization properties and to adjust the pH. The acid or acid salt may, for example, be selected from a group consisting of sulfamic acid, sulfamic acid salt, ammonium sulfamate, sodium sulfamate, magnesium sulfamate, phosphoric acid, the sodium salt of phosphoric acid, polycarboxylic acid, citric acid, butanetetracarboxylic acid, polymers and copolymers containing maleic acid and acrylic acid and their sodium salts and mixtures thereof. The polyolefin serves as a softener and/or sewing lubricant. The polyolefin is typically polyethylene and/or polypropylene. The softener must be used at a low level (about 0.5%) where good wicking properties are desired.

The fixative catalyst may, for example, be magnesium salts and selected from a group consisting of magnesium chloride and magnesium chloride activated with citric acid. For a catalyst useful in fixation of maleic acid containing polymers, salts of phosphoric acid may be used at a pH of 2.6-4.0. The aminofunctional silicone is ionizable so as to impart ionization properties to the fabric being treated. The aminofunctional silicone may, for example, be selected from a group consisting of various silicone polymers containing amine groups. The amine groups may be primary, secondary or tertiary, or quaternary and mixtures thereof.

The wetting agent may be selected from a group consisting of nonionic and anionic surfactants and mixtures thereof. The wetting agents are usually nonionic surfactants with from 12 to 18 carbon atoms in the oleophilic portion of the molecule. In the hydrophilic portion of the molecule, the ethylene oxide reacted segments usually vary from 5 to 10. Anionic surfactants may be needed to make the finishing solution compatible. Finally, the carrier is usually water although other carriers such as air, alcohols, and other water soluble compounds and mixtures thereof with or without water may be utilized.

When treating fabric made from synthetic fibers and, particularly polyesters, the composition may be modified to include an effective amount of blocked copolymer of polyester/polyethylene glycol such as is available from Piedmont Chemical in High Point, N.C. This blocked copolymer functions to make the polyester fibers of the fabric hydrophilic and thereby improves the binding of those fibers with the acid/acid salts with ionization properties.

The second compositional embodiment may be applied to the substrate in the same manner as described above for the first compositional embodiment. Drying and curing may also be done in a similar manner.

Figure 2:
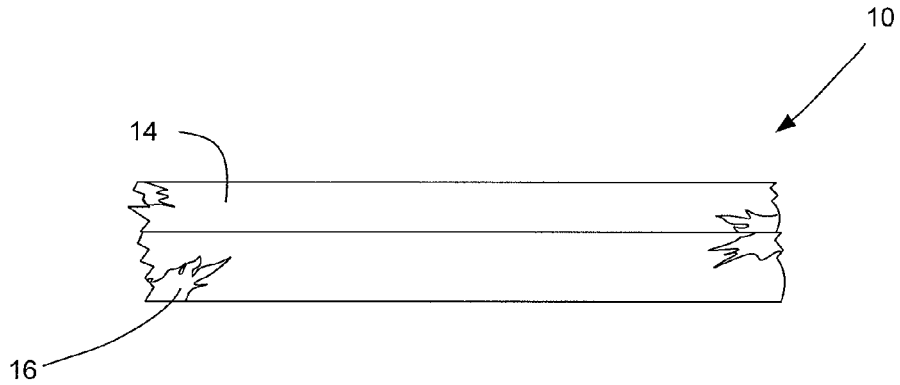
Figure 3:
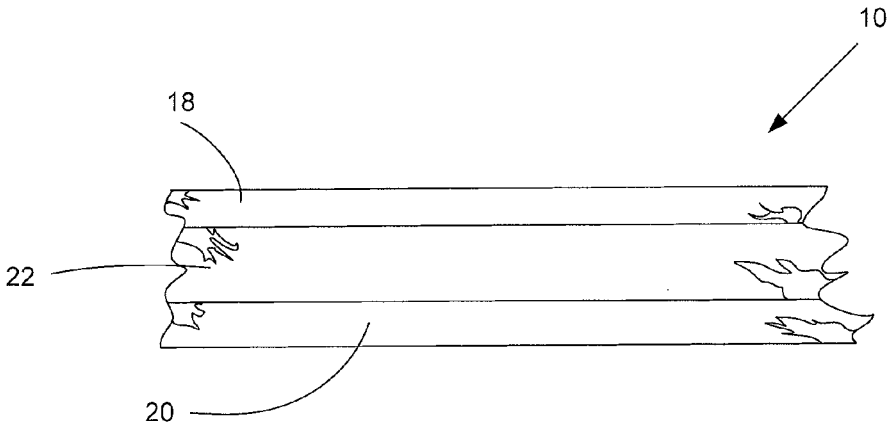

Three possible embodiments of the performance fabric of the present invention are illustrated in FIGS. 1-3. Of course, it should be realized that these different embodiments are simply presented for purposes of illustration and that the invention should not be considered as limited thereto.

In the first embodiment illustrated in FIG. 1, the fabric 10 comprises a single layer of a substrate 12 treated with one of the compositions previously described. The fabric substrate may be a cellulosic material, a noncellulosic synthetic material or a blend of the two. Fabric substrates treated with the composition of the present invention include but are not limited to cotton, linen, rayon, polyester, nylon, elastomers, acrylics, wool, silk and blends and mixtures thereof.

An alternative embodiment of the performance fabric 10 of the present invention is illustrated in FIG. 2. In this embodiment the fabric 10 comprises a substrate layer, 14 treated with the previously described composition in order to provide ionized properties and a second layer 16 of a filter material. That filter material may, for example, comprise a fabric treated with a known filtering material such as charcoal, activated carbon, chlorophyll, baking soda, activated alumina, soda lime, zeolite, calcium oxide, potassium permanganate or the like. In one possible embodiment the layer 16 comprises a fabric substrate encapsulated with activated carbon using a polyfilm. Such a filtering layer 16 reduces the release of body odor to the environment, allows for moisture management, while also protecting the covered skin from noxious chemicals in the environment. Thus, it serves a number of functions.

A third embodiment of the performance fabric 10 of the present invention is illustrated in FIG. 3. In this embodiment the performance fabric 10 comprises three separate layers. The outer two layers 18, 20 are constructed from a cellulosic material such as cotton, rayon, linen and any mixtures thereof or a noncellulosic synthetic material such as nylon, polyester, elastomers, acrylics, and mixtures thereof or even a blend of the two types of materials/fibers or natural fibers such as silk, wool, ramie, jute or blends thereof. Either or both of the layers 18, 20 may be treated with the performance enhancing compositions of the present invention in order to provide an ionization effect. A third layer 22 of filtering material may be provided between the first two layers 18, 20. The third layer 22 may comprise a fabric substrate treated with a filtering agent in the manner described above like the layer 16.

Figure 4:
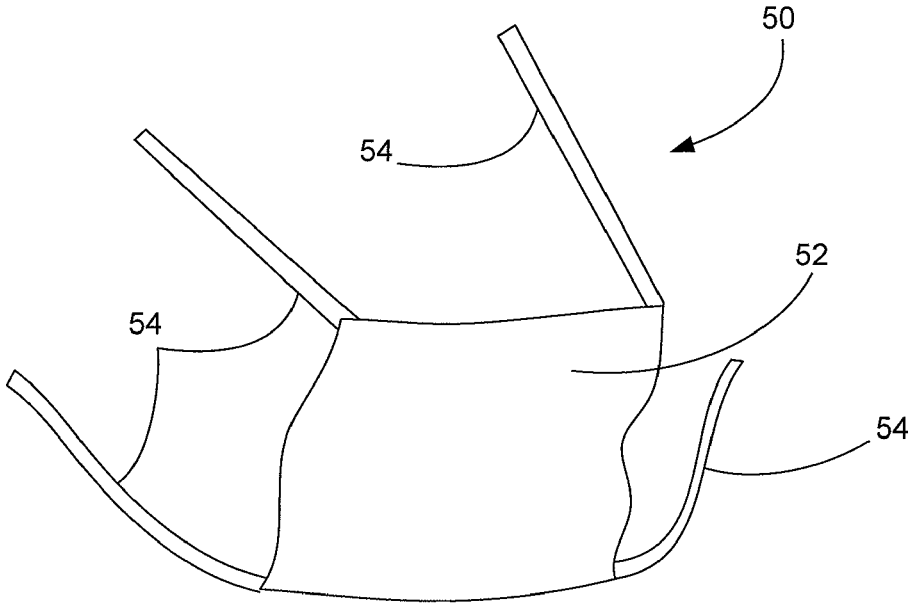
FIG. 4 is a perspective view of a surgical mask made in accordance with the teachings of the present invention.

A medical mask 50 is illustrated in FIG. 4. The medical mask 50 includes a body 52 and tie straps 54. At least the body 52 of the mask 50 is constructed from the ionized fabric of the present invention illustrated in any of FIGS. 1-3.

Figure 5:
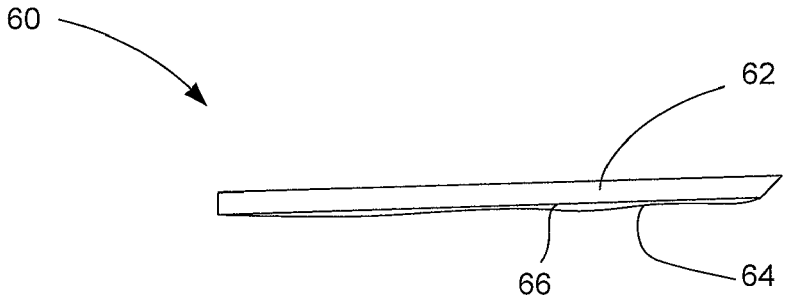
FIG. 5 is a side elevational view of medical tape made in accordance with the teachings of the present invention.

A medical tape 60 is illustrated in FIG. 5. The medical tape 60 includes a strip of fabric 62 having an adhesive 64 on one face 66 thereof. The strip of fabric 62 is constructed from the ionized fabric of the present invention as illustrated in any of FIGS. 1-3.

Substantially any type of clothing, medical wraps, surgical masks, bandages, medical tapes and domestic fabrics such as sheeting, pillowcases, bed covering, and throws may be constructed from the performance fabrics of the present invention illustrated in FIGS. 1-3. For example, the fabrics may be utilized to construct shoes, socks, pants, shorts, underwear and undergarments, shirts, sweaters, scarves, gloves, mittens and any type of hat or other head wear. All of the performance fabrics illustrated in FIGS. 1-3 include an ionized characteristic that provides various beneficial physiological effects to a wearer of clothing constructed from the fabrics. In addition the FIGS. 2 and 3 embodiments incorporate an additional filtering layer 16, 22 that functions to both reduce body odor, provide comfort through moisture management, and protect the pores of skin covered by the fabric from noxious gaseous materials in the environment. Thus, unique, multiple benefits are achieved by the wearer heretofore unknown in the art.

The fibers of the fabric substrates utilized to make the clothing may be imparted with ionized properties by a number of methods. The chemistry will depend on both the fibers and the particular chemical group to be fixed. As would be expected, cellulosic fibers respond differently from non-cellulosic synthetics. Furthermore the finish will also depend on the final balance of physical properties desired for the garment.

For cellulosic fibers such as cotton, rayon, and linen, ionic groups may be fixed by a number of methods. Some of these approaches include (1) partial carboxymethylation using a sodium salt of chloroacetic acid and sodium hydroxide; (2) reactive polycarboxylic acids with appropriate catalyst, pH and heat; (3) phosphorylation with ammonium phosphate and urea; (4) sulfation with appropriate salts of sulfamic acid; (5) fixation of reactive dyes and colorless reactive dyes; (6) fixation of epoxy functional cationic compounds; and (7) fixation of ionic polymers such as carboxymethyl cellulose, sulfonated phenolic/formaldehyde polymers, carboxylated acrylic polymers, partial oxidized polyethylene and aminofunctional silicones.

Non-cellulosic synthetic fiber such as polyester and nylon are not as reactive as the cellulosic fibers. For these non-cellulosic synthetic fibers fixation of the reactive groups must be more on the surface. Reactive polycarboxylic acid compounds have been effective in fixing cationic compounds such as choline chloride. This reaction in combination with oxidized polyethylene and aminofunctional silicones has been effective in achieving desirable ionic properties on synthetic fibers.

The presence and the durability of the ionizeable finish may be determined by several methods. Where the ionizeable finish uses a sulfur compound such as a sulfate, an elemental analysis of the amount of sulfur present may be used. A rapid method is to perform a dyeing with a cationic dye such as methylene blue. In this case the cationic dye is attracted to the anionic sulfate group. The presence and the intensity of the blue color will indicate the relative amount of the sulfate groups. This testing can best be conducted on white fabric. A second method is to measure the electrical resistivity of the fabric. Ionizeable finishes decrease the electrical resistivity and also decrease the time of decay of a given charge on the fabric. Various ionizeable finishes will affect this electrical resistivity differently.

The following examples are to further illustrate the invention but it is not to be considered as limited thereto.

Example 1

Finish for Cellulosic Containing Fabrics

| | % On Weight of Bath |
|---|---|
| Water | 84.5 |
| Wetting agent (generic) | 0.2 |
| Ultrasoft NPE 40 (oxidized polyethylene | 1.0 |

-continued

| | % On Weight of Bath |
|---|---|
| Softener made by MFG Company) | |
| Sil Fin WHP (aminofunctional silicone made by Boehme Filatex Company) | 1.0 |
| Supercotton 102 (a proprietary sulfamic acid based Product made by Lanxess, formerly Bayer Corp.) | 13.3 |

This finish was padded on the cellulosic containing fabric, dried and cured in one pass at 340° F. at 16 yards per minute.

Example 2

Finish for Noncellulosic Containing Synthetic Fabrics

| | % On Weight of Bath |
|---|---|
| Water | 70.4 |
| Crosslink RB 105 (a reactive polycarboxylic acid made by Biolab, Inc.) | 8.0 |
| Crosslink WC 205 (a sodium hypophosphite catalyst made by Biolab, Inc.) | 4.0 |
| Choline chloride (70% active, made by BCP Corp.) | 3.6 |
| Caustic soda (50% sodium hydroxide) | 0.8 |
| Water | 10.0 |
| Ultrasoft NPE 40 (oxidized polyethylene softener made by MFG Company) | 1.5 |
| Sil Fin WHP (an aminofunctional silicone made by Boehme Filatex) | 1.5 |
| Wetting agent (generic) | 0.2 |

The Ultrasoft NPE 40, Sil Fin WHP, wetting agent, and the 10% water were mixed together and added slowly with stirring to the other ingredients added in the order indicated. The fabric was padded and then dried under heat setting conditions of 380° F. for 48 seconds.

Example 3

Ammonium dihydrogen phosphate, urea, ammonia, and a wetting agent were padded onto a white 100% cotton 14¾ oz. bleached twill at 66% wet pick-up with the following formulation on weight of the bath:

| | |
|---|---|
| Urea | 3% |
| Ammonium dihydrogen phosphate | 3% |
| Wet Aid NRW | 0.1% |
| Ammonia, 27% | 0.2% |

The fabric was dried 10 minutes at 250° F., then cured 10 minutes at 300° F. To illustrate durability, the fabric was given ten home launderings according to AATCC Test Method 135. The washed fabric was then dyed along with an untreated control with 0.5% of the cationic dye, Methylene Blue at 120° F. for 10 minutes, then rinsed with cold water for 10 minutes to determine the relative degree of anionic character that had been added to the cotton fabric. The treated and washed fabric was a deep Navy shade while the untreated control was only a light blue. In this example, the ammonium dihydrogen phosphate provides the ionization effect to the fabric.

Example 4

Ammonium sulfamate, a glycolated Dimethylol-dihydroxy-diethylene urea resin, magnesium chloride catalyst containing citric acid, a wetting agent, a polyethylene softener, and an aminofunctional silicone softener were padded onto a white 100% cotton shirting fabric at 61% wet pick-up with the following formulation of weight of the bath:

| | |
|---|---|
| Ammonium sulfamate, 47% | 10% |
| Permafresh TG | 10% |
| Catalyst 531 | 3% |
| Wet Air NRW | 0.2% |
| Ultrasoft NPE-40 | 1% |
| Sil-Fin WHP | 1% |

The fabric was dried 10 minutes at 250° F. and cured 2 minutes at 340° F. To illustrate durability, the fabric was given ten home launderings according to AATCC Test Method 135. The washed fabric was then dyed along with an untreated control with 0.5% of the cationic dye, Methylene Blue at 120° F. for 10 minutes, then rinsed with cold water for 10 minutes to determine the relative degree of anionic character that had been added to the cotton fabric.

The treated and washed fabric was a deep Navy shade while the untreated control was only a light blue. In this example, the ammonium sulfamate provides the ionization effect to the fabric.

To determine electrical conductivity the treated swatch that had been washed ten times and an untreated control were tested for Charge Dissipation on a Rothschild Static Voltmeter with the following results:

| Sample | Seconds to Dissipate One-half of 100-Volt Charge Across Fabric Between Poles |
|---|---|
| Untreated Control | 18 seconds |
| Treated Fabric | 2 seconds |

Shrinkage of the treated and untreated swatches were compared to illustrate that crosslinking of the resin was taking place:

| Sample | % Shrinkage After 1 HL | % Shrinkage After 10 HL |
|---|---|---|
| Untreated Control | 3.6 | 5.2 |
| Treated Fabric | 2.5 | 3.4 |

Warp Tensile and Warp Tear strength was compared with the following results:

| Sample | Tensile, lb. | Tear, lb. |
|---|---|---|
| Untreated Control | 117.83 | 2.85 |
| Treated Fabric | 96.26 | 3.33 |

Example 5

Example 4 was repeated except that the glycolated Dimethylol-dihydroxy-diethylene urea resin was replaced with a non-formaldehyde Dimethylurea/glyoxal resin, and the following formulation was applied:

| | |
|---|---|
| Ammonium sulfamate, 47% | 10% |
| Fixapret NF | 10% |
| Catalyst 531 | 3% |
| Wet Air NRW | 0.2% |
| Ultrasoft NPE-40 | 1% |
| Sil-Fin WHP | 1% |

The fabric was dried 10 minutes at 250° F. and cured 2 minutes at 340° F. To illustrate durability, the fabric was given ten home launderings according to AATCC Test Method 135. The washed fabric was then dyed along with an untreated control with 0.5% of the cationic dye, Methylene Blue at 120° F. for 10 minutes, then rinsed with cold water for 10 minutes to determine the relative degree of anionic character that had been added to the cotton fabric.

The treated and washed fabric was a deep Blue shade while the untreated control was only a light blue. In this example, the ammonium sulfamate provides the ionization effect to the fabric.

To determine electrical conductivity the treated swatch that had been washed ten times and an untreated control were tested for Charge Dissipation on a Rothschild Static Voltmeter with the following results:

| Sample | Seconds to Dissipate One-half of 100-Volt Charge Across Fabric Between Poles |
|---|---|
| Untreated Control | 18 seconds |
| Treated Fabric | 3 seconds |

Shrinkage of the treated and untreated swatches were compared to illustrate that normal crosslinking of the resin was taking place:

| Sample | % Shrinkage After 1 HL | % Shrinkage After 10 HL |
|---|---|---|
| Untreated Control | 3.6 | 5.2 |
| Treated Fabric | 3.0 | 4.2 |

Warp Tensile and Warp Tear strength was compared with the following results:

| Sample | Tensile, lb. | Tear, lb. |
|---|---|---|
| Untreated Control | 117.83 | 2.85 |
| Treated Fabric | 110.79 | 2.50 |

Example 6

Sodium sulfamate, a glycolated Dimethylol-dihydroxy-diethylene urea resin, magnesium chloride catalyst containing citric acid, a wetting agent, a polyethylene softener, an aminofunctional silicone softener, plus an optical brightener and bluing agent were padded onto a white 100% cotton 8 oz. twill fabric at 67% wet pick-up with the following formulation of weight of the bath:

| | |
|---|---|
| Sodium sulfamate, 50% | 10% |
| Permafresh TG | 10% |
| Catalyst 531 | 3% |
| Wet Air NRW | 0.2% |
| Ultrasoft NPE-40 | 1% |
| Sil-Fin WHP | 1% |
| Uvitex RSB | 1% |
| Pad N Blue 2GC (1 g/L) | 0.5% |
| Pad N Violet 4B (1 g/L) | 0.5% |

The fabric was dried ten minutes at 250° F., then cured one minutes at 340° F. To illustrate durability, the fabric was given ten home launderings according to AATCC Test Method 135. The washed fabric was then dyed along with an untreated control with 0.5% of the cationic dye, Methylene Blue at 120° F. for 10 minutes, then rinsed with cold water for 10 minutes to determine the relative degree of anionic character that had been added to the cotton fabric. The treated and washed fabric was a deep Navy shade while the untreated control was only a light blue. In this embodiment, the sodium sulfamate provides the ionization effect to the fabric.

Example 7

Citric acid, a glycolated Dimethylol-dihydroxy-diethylene urea resin, magnesium chloride catalyst, a wetting agent, a polyethylene softener, an aminofunctional silicone softener, plus an optical brightener and bluing agent were padded onto a white 100% cotton 8 oz. twill fabric at 67% wet pick-up with the following formulation of weight of the bath:

| | |
|---|---|
| Citric Acid | 5% |
| Permafresh TG | 10% |
| Catalyst KR | 3% |
| Wet Air NRW | 0.2% |
| Ultrasoft NPE-40 | 1% |
| Sil-Fin WHP | 1% |
| Uvitex RSB | 1% |
| Pad N Blue 2GC (1 g/L) | 0.5% |
| Pad N Violet 4B (1 g/L) | 0.5% |

The fabric was dried ten minutes at 250° F., then cured one minutes at 340° F. To illustrate durability, the fabric was given ten home launderings according to AATCC Test Method 135. The washed fabric was then dyed along with an untreated control with 0.5% of the cationic dye, Methylene Blue at 120° F. for 10 minutes, then rinsed with cold water for 10 minutes to determine the relative degree of anionic character that had been added to the cotton fabric.

The treated and washed fabric was a deep Navy shade while the untreated control was only a light blue. In this example, the citric acid provides the ionization effect to the fabric.

Example 8

An ionization finishing composition or formulation for synthetic fibers includes 0.4% anionic surfactant, 0.2% nonionic surfactant, 4.0% polyester/polyethylene glycol blocked copolymer, 10.0% maleic acid/acrylic acid copolymer (adjusted to a pH of 2.8 with phosphoric acid) and the balance water.

The same formulation may also be used on cellulose containing fabrics. Other softeners such as polyethylene and silicones may be added. The type and amount of the softness will depend upon the moisture management properties desired. The molecular weight of the maleic acid/acrylic acid copolymer should be at least 20,000 for optimum performance.

The foregoing description of the preferred embodiments of this invention has been presented for purposes of illustration and description. It is not intended to be exhaustive or to limit the invention to the precise form disclosed. Obvious modifications or variations are possible in light of the above teachings.

The embodiments were chosen and described to provide the best illustrations of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims and their fair and broad interpretation in any way.

The invention claimed is:

1. A composition for treating fabric to impart an ionization effect, said composition consisting of:

about 5% to about 15.0%, by weight percent, maleic acid/acrylic acid copolymer, or salts thereof, having a molecular weight of at least about 20,000;

a blocked copolymer of polyester/polyethylene glycol;

about 0.01% to about 4.0%, by weight percent, anionic surfactant;

about 0.01% to about 4.0%, by weight percent, nonionic surfactant; and a carrier, wherein said composition has a pH in the range of about 2.0 to about 4.0, wherein durability is determined based a laundering according to AATCC Test Method 135, and wherein ionization is determined by a decreased time to dissipate one-half of a 100-volt charge using a Rothschild Static Voltmeter.

2. The composition of claim 1, wherein said blocked copolymer of polyester/polyethylene glycol is present in a concentration, by weight percent, of about 0.1% to about 5.0%.

3. The composition of claim 1, wherein said maleic acid/acrylic acid copolymer has a molecular weight of about 20,000.

4. The composition of claim 1, wherein said carrier is water.

5. The composition of claim 1, wherein said composition is configured to impart said ionization effect on a fabric including synthetic fibers.

6. The composition of claim 1, wherein said composition is configured to impart said ionization effect on a fabric including cellulosic fibers.

7. The composition of claim 1, wherein said composition is configured to impart said ionization effect on a fabric including synthetic fibers and cellulosic fibers.

8. A method of ionizing a fabric comprising treating it with a composition according to claim 1.

9. The method of claim 8, wherein said fabric includes synthetic fibers.

10. The method of claim 8, wherein said fabric includes cellulosic fibers.

11. The method of claim 8, wherein said fabric includes cellulosic fibers and synthetic fibers.

12. A composition for treating fabric to impart an ionization effect, said composition consisting of:

about 5% to about 15.0%, by weight percent, maleic acid/acrylic acid copolymer, or salts thereof, having a molecular weight of at least about 20,000;

a blocked copolymer of polyester/polyethylene glycol;

about 0.01% to about 4.0%, by weight percent, anionic surfactant;

about 0.01% to about 4.0%, by weight percent, nonionic surfactant;

by weight percent, about 0.1% to about 8.0% of a fixative catalyst; and a carrier, wherein said composition has a pH in the range of about 2.0 to about 4.0;

wherein durability is determined based a laundering according to AATCC Test Method 135, and wherein ionization is determined by a decreased time to dissipate one-half of a 100-volt charge using a Rothschild Static Voltmeter.

13. The composition of claim 12, wherein said fixative catalyst is phosphoric acid or a salt thereof.

* * * * *

UNITED STATES PATENT AND TRADEMARK OFFICE

CERTIFICATE OF CORRECTION

PATENT NO. : 7,896,928 B2
APPLICATION NO. : 12/182275
DATED : March 1, 2011
INVENTOR(S) : Wolfgang A. Strahl et al.

It is certified that error appears in the above-identified patent and that said Letters Patent is hereby corrected as shown below:

Title Page, Item (75) Inventors should read:

--(75) Inventors: Wolfgang A. Strahl, Wilmington, NC (US); Ellis Davis, Jr., Easley, SC (US)--.

Signed and Sealed this
Third Day of May, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,896,928 B2
APPLICATION NO. : 12/182275
DATED : March 1, 2011
INVENTOR(S) : Strahl et al.

It is certified that error appears in the above-identified patent and that said Letters Patent is hereby corrected as shown below:

Delete the title page and substitute therefore the attached title page consisting of corrected items (12) and (75).

This certificate supersedes the Certificate of Correction issued May 3, 2011.

Signed and Sealed this
Twenty-ninth Day of November, 2011

David J. Kappos

David J. Kappos
*Director of the United States Patent and Trademark Office*

(12) United States Patent
Strahl et al.

(10) Patent No.: US 7,896,928 B2
(45) Date of Patent: Mar. 1, 2011

(54) IONIZED PERFORMANCE FABRIC COMPOSITION

(75) Inventors: Woflgang A. Strahl, Wilmington, NC (US); Ellis Davis, Jr., Easley, SC (US); John D.Turner, Inman, SC (US)

(73) Assignee: STRA, LLC, Easley, SC (US)

( * ) Notice: Subject to any disclaimer, the term of this patent is extended or adjusted under 35 U.S.C. 154(b) by 142 days.

(21) Appl. No.: 12/182,275

(22) Filed: Jul. 30, 2008

(65) Prior Publication Data

US 2009/0029614 A1 Jan. 29, 2009

Related U.S. Application Data

(63) Continuation of application No. 11/246,536, filed on Oct. 7, 2005.

(60) Provisional application No. 60/616,999, filed on Oct. 8, 2004.

(51) Int. Cl.
*D06M 13/10* (2006.01)
*D06M 13/184* (2006.01)

(52) U.S. Cl. ..... 8/115.6; 8/115.51; 8/115.7; 8/116.1; 8/120; 8/112; 252/8.61

(58) Field of Classification Search ..... 8/115.51, 8/115.6, 115.7, 116.1, 112, 120; 252/8.61 8.82
See application file for complete search history.

(56) References Cited

U.S. PATENT DOCUMENTS

| | | | | |
|---|---|---|---|---|
| 2,681,846 | A | 6/1954 | Guthrie et al. | |
| 2,726,133 | A | 12/1955 | Helfenberger et al. | |
| 3,783,085 | A | 1/1974 | Person et al. | |
| 4,181,498 | A | 1/1980 | Koltai et al. | |
| 4,244,059 | A | 1/1981 | Pflaumer | |
| 4,455,187 | A | 6/1984 | von Blucher et al. | |
| 4,510,193 | A | 4/1985 | Blucher et al. | |
| 4,702,857 | A * | 10/1987 | Gosselink | 510/299 |
| 4,975,317 | A | 12/1990 | Kuhn et al. | |
| 5,057,710 | A | 10/1991 | Nishiura et al. | |
| 5,478,489 | A | 12/1995 | Fredj et al. | |
| 5,490,865 | A | 2/1996 | Scheiwiller | |
| 5,539,930 | A | 7/1996 | Sesselmann | |

(Continued)

FOREIGN PATENT DOCUMENTS

| | | |
|---|---|---|
| JP | 49033718 | 9/1974 |

OTHER PUBLICATIONS

Lewis, D.M. et al., Improved Cellulous Dycability by Chemical Modificationof the Fiber, Textile Chemist and Colorist, Oct. 1989, p. 23.

(Continued)

*Primary Examiner* Lorna M Douyon
*Assistant Examiner*—Tri V Nguyen
(74) *Attorney, Agent, or Firm* MacCord Mason PLLC

(57) ABSTRACT

A composition for treating fabric includes about 0.1 to about 10.0% cross linking agent, about 0.1 to about 5.0% polyolefin, about 0.1 to about 0.5% wetting agent, about 0.0 to about 8.0% aminofunctional silicone, about 0.0 to about 6.0% ionizing agent, about 0.0 to about 2.0% catalyst and any remainder as a carrier. The composition has a pH of between about 2.0 to about 4.0 and at least some aminofunctional silicone and/or ionizing agent is provided.

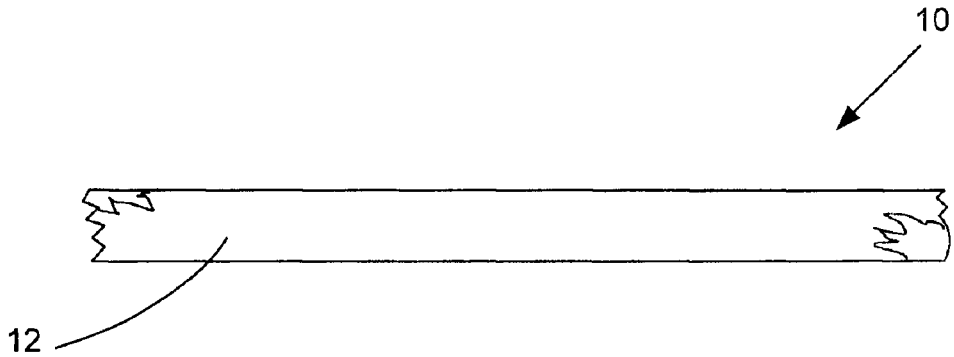

13 Claims, 2 Drawing Sheets